US007619606B2

(12) United States Patent
Kaehler et al.

(10) Patent No.: US 7,619,606 B2
(45) Date of Patent: Nov. 17, 2009

(54) DEVICES AND METHODS FOR INTRADEVICE OPTICAL COMMUNICATION OF DATA

(75) Inventors: John W. Kaehler, Lake Bluff, IL (US); Ken K. Foo, Gurnee, IL (US)

(73) Assignee: Motorola, Inc., Schaumburg, IL (US)

( * ) Notice: Subject to any disclaimer, the term of this patent is extended or adjusted under 35 U.S.C. 154(b) by 619 days.

(21) Appl. No.: 11/321,311

(22) Filed: Dec. 29, 2005

(65) Prior Publication Data

US 2007/0152950 A1 Jul. 5, 2007

(51) Int. Cl.
*G09G 3/36* (2006.01)

(52) U.S. Cl. ..... 345/102; 349/61

(58) Field of Classification Search ..... 345/102; 370/527, 529

See application file for complete search history.

(56) References Cited

U.S. PATENT DOCUMENTS 5,781,321 A * 7/1998 Kobayashi ..... 398/115
6,490,393 B1 * 12/2002 Zhou ..... 385/37
6,874,926 B2 4/2005 Nousiainen
6,961,105 B2 * 11/2005 Chang et al. ..... 349/114
2004/0136155 A1 * 7/2004 Onishi et al. ..... 361/683
2006/0066783 A1 * 3/2006 Sampsell ..... 349/114

* cited by examiner

*Primary Examiner*—Amare Mengistu
*Assistant Examiner*—Koosha Sharifi
(74) *Attorney, Agent, or Firm*—Lawrence J. Chapa

(57) ABSTRACT

Disclosed are devices and methods for intradevice communication in a mobile communication device having a display. A method includes providing a supply signal and superimposing a data signal onto the supply signal. The method further includes driving a light source with the supply signal and the superimposed data signal to produce light to illuminate the display. Also included is sensing the light illuminating the display with an optical sensor, which is coupled to a receiver circuit, and then distinguishing the data signal from the sensed light with the receiver circuit. An image is formed on the display using the data signal distinguished with the receiver circuit.

20 Claims, 5 Drawing Sheets

DEVICES AND METHODS FOR INTRADEVICE OPTICAL COMMUNICATION OF DATA

FIELD

The present disclosure relates to intradevice communication of data, and more particularly to optical communication by superimposing a data signal on a supply signal for a display backlight.

BACKGROUND

Mobile communication devices are increasing popular for communication and other tasks. As their functionality has increased, the need for additional surface area on which larger displays, finger friendly keypads, as well as the placement of camera apertures, speaker ports, battery charger jacks, and communication cable jacks can be placed on the device has also increased. This has created challenges in meeting the demand for increasingly smaller devices. To maximize surface area, a common design chonfiguration in cellular telephones, for example, is a device having two housings that are connected by a coupling mechanism, which enables the two parts to move relative to one another. The first housing will often include the keypad, the battery, the microphone, and much of the control circuitry of the telephone including various hardware and software elements. The second housing for example can include one or more display elements, speaker ports, as well as other supporting circuitry.

There are many different ways to configure a cellular telephone having two housings. For example, a hinge and/or a rotatable coupling between the two housings may be used for a "clamshell" model or a "rotator" model. Alternatively, the second housing may slide over the first housing to open the device. In a "slide" configuration, the two housings may be connected together without the use of a hinge. In the clamshell model, the second housing traditionally folds closed over the first housing when the telephone is not in use.

In clamshell phones, the second housing or the flip usually contains the earpiece or speaker, and two displays, one on either side of the second housing. The first housing or base usually contains the keypad and a lion's share of the hardware and software components. Most clamshell phones have a feature called "active flip," with which calls can be answered and ended through a detection of the opening and closing of the telephone (i.e. the two part housing).

Of course, there are more dual (first and second) housing configurations than those discussed here. The common feature of the different dual housing configurations is that they are connected by an appropriate type of housing connector mechanism. Because active elements are often placed in the flip portion of the housing away from the main control and power circuitry, which are typically located within the base portion of the housing, wires extend from the first housing (i.e. base) to the second housing (i.e. flip) through the housing coupling mechanism to support the functions of the features located in the second housing.

When a second housing includes two displays, the first display typically is viewable when the device is open, and a second display typically is viewable when the device is closed. Commonly the displays will project different information, which generally requires different data signals to be generated for driving each of the first and second display. Furthermore differences in the size and the display capabilities may result in more or less data needing to be sent for purposes of projecting the desired information. For example, the first display may be a full screen display located in the second housing. The second display in the second housing may be a smaller caller line identification (CLI) display. Oftentimes, the CLI may include more than just caller ID data. It may also include time and date, plus potentially other information.

A substantial number of the display apparatus' processing components are housed in the first housing. Leads from the first housing for both display devices are threaded through the housing connector mechanism to the second housing. For example, the lines can include those for power, ground, and control and I/O signal lines. There may be, for example, eight lines for eight bit or sixteen lines for sixteen bit parallel communication with a CPU, with numerous additional lines. In order to support more than one display, more than one set of lines may generally be involved, which together can include dozens of lines.

While there is a trend toward smaller cellular telephone devices, there is also a trend toward more features and higher capability for the current features. Fewer and smaller hardware and software components are therefore desirable to enable a higher number of features and to improve the current features in the smaller devices (i.e. do more with less). Accordingly, it may be beneficial to eliminate a portion or all of one set of leads that supports one of the displays.

Communication of data to the display devices, in general, can be a significant source of power consumption in devices. With more and better features in the new smaller devices creating additional drain on power resources, it would be further beneficial if the power needs for the communication of data to the one or more displays were reduced.

DETAILED DESCRIPTION

Figure 1:
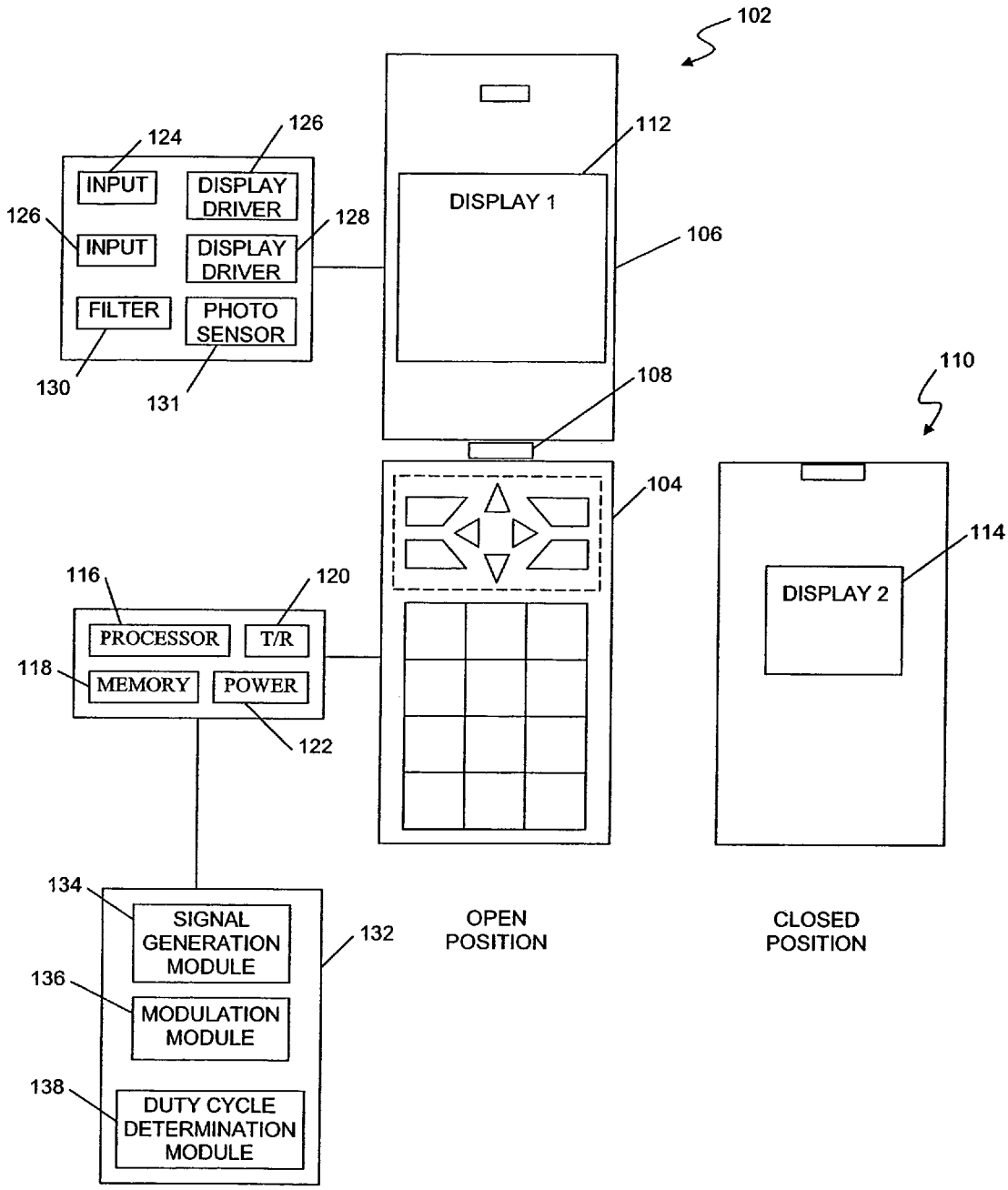
FIG. 1 depicts an embodiment of a mobile communication device 102 having a clam shell configuration.

FIG. 1 shows a mobile communication device 102 that is depicted having a clam shell configuration. The first housing 104 is coupled to the second housing 106 by the housing connector mechanism 108. The mobile communication device, as depicted therein, is in an open position. Next to it, the mobile communication device is depicted in a closed position 110. In the open position, a first display 112 can be visible. In the closed position, a second display 114 can be visible. The second display can be a caller line identification (CLI) display or can be any other type of display. Relative to the disclosed embodiment, the second display will also be generally viewable, when the device is in an open position from the back side of the device, which is not expressly shown.

Disclosed is an optical communication data link between a backlight, which can support both the first and second displays, and a driver of the second display. A supply signal for driving the backlight includes data intended for the second display superimposed thereon. An optical modulated signal can be accordingly generated by the backlight and received by the driver of the second display. That is, light from the backlight is reused for optical transmission of data to the second display.

Data for use by the two displays can be transmitted from the first housing to the second housing in different manners. Depending upon the bandwidth of data delivery hardware in the connection mechanism between the first housing to the first display of the second housing, the data may be sent in either one or more data signal lines or data feeds. In any event, the driving circuit for the backlight for use by the second display, accordingly may be used to provide an optical signal which includes a superimposed data signal. The receiver circuit of the second display may be adapted for distinguishing the data signal from the sensed light. The data signal can be used by a display driver of the second display to render the image to be projected by the second display.

In an active mode, which may correspond to a duty cycle greater than 50%, the backlight can illuminate the first display. In an inactive mode, which may correspond to a duty cycle of less than 50%, the first display may not be illuminated. The term duty cycle will be discussed in more detail below. The driving circuit for the backlight can be configured to provide an optically conveyed signal with a superimposed data signal for the second display when the first display is active and/or when the first display is inactive. By using the backlight of the first display to generate an optical data link between the backlight and the second display in active or inactive mode, the data delivery hardware connecting the first housing to the second housing in order to drive the first and second displays can be reduced. In this way, fewer lines are needed from the first housing to the second housing through the housing connector mechanism.

The instant disclosure is provided to further explain in an enabling fashion the best modes of making and using various embodiments in accordance with the present invention. The disclosure is further offered to enhance an understanding and appreciation for the invention principles and advantages thereof, rather than to limit in any manner the invention. The invention is defined solely by the appended claims including any amendments of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions. Much of the inventive functionality and many of the inventive principles are best implemented with or in software programs or instructions and integrated circuits (ICs) such as application specific ICs. It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. Therefore, in the interest of brevity and minimization of any risk of obscuring the principles and concepts according to the present invention, further discussion of such software and ICs, if any, will be limited to the essentials with respect to the principles and concepts within the preferred embodiments.

FIG. 1 further shows several hardware and software components of device 102. The mobile communication device represents a wide variety of communication devices that have been developed for use within various networks. Such handheld communication devices include, for example, cellular telephones, messaging devices, mobile telephones, personal digital assistants (PDAs), notebook or laptop computers incorporating communication modems, mobile data terminals, application specific gaming devices, video gaming devices incorporating wireless modems, and the like. Any of these portable devices may be referred to as a mobile station or user equipment. Herein, wireless and wired communication technologies can include the capability of transferring high content data. For example, the mobile communication device 102 can provide Internet access and/or multi-media content access.

The first housing 104 can include components such as a processor 116, memory 118, at least one transceiver (transmitter and receiver) 120, and a power source 122. The second housing can contain a first input connection 124, a first display driver 126 and a second input connection 126 for a second display driver 128. The input connections are for receiving data signals for the first display and the second display from components of the first housing. There may be at least one filter 130 shown as well which will be discussed below. There is also at least one photosensor 131, to be discussed below.

The first or second housing may also include a plurality of modules including modules 132. The modules may be hardware and/or software and can include signal generating module 134, a modulating module 136 and a duty cycle determination module 138. It is understood that other modules can be included as well. The functionality of those listed here will be discussed in detail below.

Figure 2:
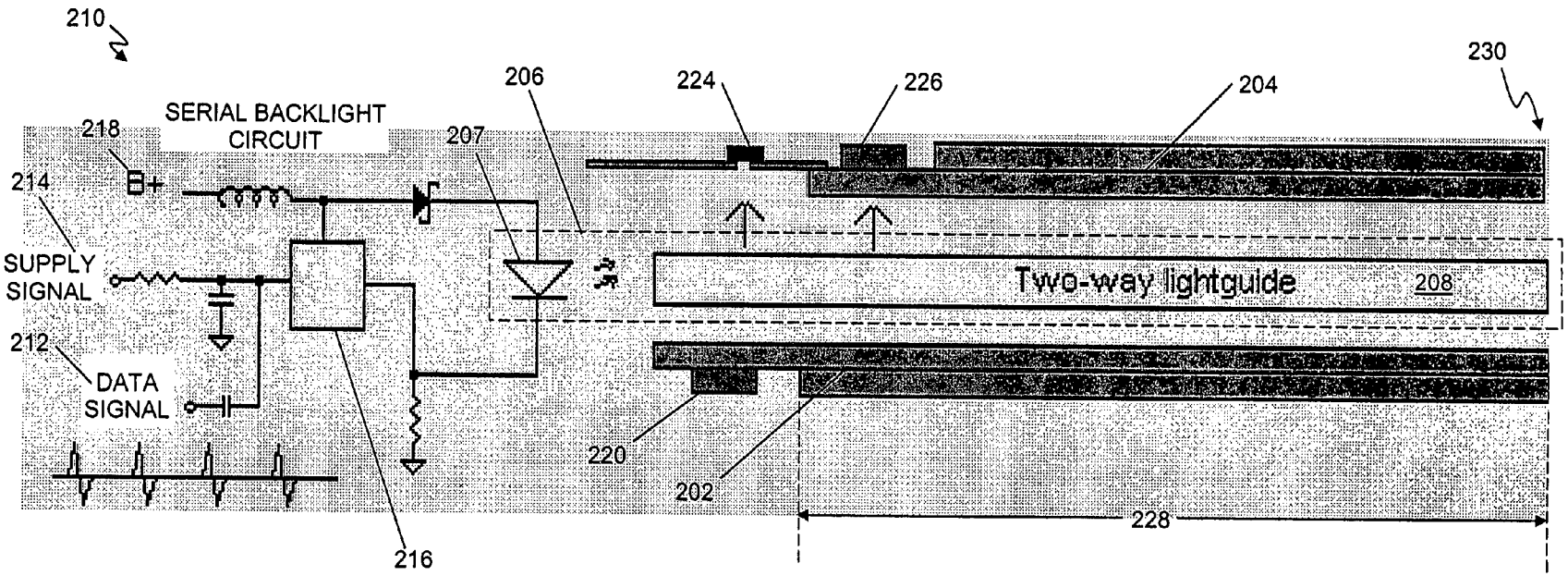
FIG. 2 shows a circuit schematic of a display circuit including illustrating an exemplary relative positional placement of some of the elements, in accordance with at least one aspect of the present invention.

FIG. 2 shows a side view of components of first or main display 202 (depicted in FIG. 1 as 112) and the second display 204 (depicted in FIG. 1. as 114). As depicted in FIG. 1, the displays can be located on opposite sides of the second housing. In that event, they may share a backlight 206 with an illumination source 207 and a two-way light guide 208 that is positioned between them. In another embodiment one-way light guides may be used, as discussed further below.

A light guide is typically clear plastic or glass having a light source so that the light can be conducted inside the light guide. The light may be conducted until it reaches an end, or a surface that is patterned so that the light is dispersed therefrom. A light guide can be adapted to conduct light from the source to where the illumination is targeted. The source of light to the light guide can be the single illumination source 207 shown or may include a plurality of illumination sources. The illumination source may be for example, an LED. Typically one or more white light LEDs may be used. In addition to a first light source there may be another backlight circuit at another end of the light guide 208, as well. In another backlight configuration, the backlight may include an elongate lighting source to provide light to the light guide.

Due to their small size, brightness, and cost efficiency, light emitting diodes (LEDs) are commonly used as a source of light in small displays such as those in handsets. In the present technology an LED can allow switching on and off at varying rates to carry a data signal. A diode is an electrical component that allows electric current to pass with little resistance in a first direction, and provides a much higher resistance to current in the opposite direction. The first direction is referred to as the forward direction and the current passing in that direction is referred to as forward current. A small current which in some circumstances may pass in the opposite direction is referred to as reverse current. The reverse current may be assumed in many circumstances to be substantially zero.

An LED emits light with the application of a forward current. In a white light LED, also referred to herein as a white LED, the LED element may emit light having a range of frequencies across at least a portion of the visible spectrum, and which can include light having a frequency in the visible spectrum corresponding to a relatively shorter wavelength (blue light). At frequencies associated with blue light, an LED may be a more efficient light emitter than one that more predominantly emits light of longer wavelengths. Moreover, LEDs which produce light at frequencies having predominately shorter wavelengths may still be used to produce light of longer wavelengths (i.e. other colors) through the down-conversion of the shorter-wavelength light. In a down-conversion process, atoms in a phosphor absorb the energy in light of one wavelength. The atoms may release the energy through subsequent emission of light. Typically the emitted light has a longer wavelength, and thus a different color, for example, yellow or red, than the light originally absorbed. In white light LEDs, a phosphor or mixture of phosphors incorporated in the LED package down-converts at least a part of the LED output to longer wavelengths. The resulting mixture of wavelengths may be perceived as white light which may be desirable in the application of backlighting a handset display. Typically, the LED manufacturer provides a value of forward current to be used to achieve an output spectrum within design specification for the white LED.

In order to provide brightness control for a white LED, pulse width modulation (PWM) of the forward current is used so that the LED can be turned off and on. In this method of brightness control, the LED can be driven either with substantially the design value of forward current, or with substantially no forward current applied to the LED. That is, the current applied to the LED can take on values of substantially zero, or substantially the forward current value for white light output according to manufacturer's design specifications.

In a typical application using PWM, the driving current may be switched between the two extreme values at a rate which may be as low as 100 Hz or as high as 100 kHz. The LED alternates at the switching rate between periods of light emission and periods of substantially no emission. With values of the switching rate below 100 Hz, flicker of the LED light may be perceived, but the human eye is typically incapable of registering brightness changes over shorter timescales (that is, at higher switching rates). The human eye registers the average brightness value when PWM is used to control LED brightness.

The PWM frequency controls the frequency at which the LED is switched on and off. The width of the pulses in PWM controls the duration of the periods of light emission, and together with the PWM frequency determines the duty cycle of the LED. The duty cycle may also be referred to as the duty cycle of the supply signal. When the pulse width and frequency are adjusted so that the LED is emitting for 50% of the time, the duty cycle of the LED is 50%. In a completely analogous way, a duty cycle of 10% results in LED emission of light 10% of the time (and substantially no emission 90% of the time), resulting in a dim LED. As another example, a duty cycle of 90% results in LED emission of light 90% of the time (and substantially no emission 10% of the time), leading to a bright LED.

Thus, when the backlight is relatively active, the supply signal driving the LED associated with the backlight may have a duty cycle greater than 50%. When the backlight is relatively inactive, the supply signal driving the LED associated with the backlight may have a duty cycle less than 50%.

As shown in FIG. 2, delivering the data for the second display includes the re-use of the backlight as the data transmitter to the second display. FIG. 2 shows a circuit diagram of a backlight circuit 210 including a backlight 206. As previously discussed, the backlight includes an illumination source 207 which may include, for example, one or more LEDs. The data is transmitted by a data signal line 212 to the backlight where the light is modulated for optical transmission to a photosensor 224 and driver 226 of the second display. As previously discussed, a pulse width modulator can provide a supply signal 214 to a controller 216. A data signal 212 may be supplied along with the supply signal 214. The controller 216 can control the driving current for the LED 207, according to the supply signal 214 modulated with the data signal 212, so that the illumination device 207 can be driven with the supply signal and the superimposed data signal. A power source 218 can provide power to the circuit that can be in a smaller amount than were the second display to be independent from the first display.

The LED 207 can provide light to the light guide 208 for receipt by the driver of the second display. (The driver of the first display 220 can receive instructions and/or data from a different source.) In the case of the second display, the supply signal and the superimposed data signal can be generated by the backlight so that the photosensor 224 detects the light. The second display driver 226, coupled to the photosensor, can accordingly convert the superimposed data signal into instructions for the second display. Alternatively, the photosensor 224 can be embedded into an integrated circuit, which may be used to form at least portions of the display driver 226. The driver provides signals or electrical current to the display 204 to activate a display screen pixel. The display 204 can thus generate indicia.

It is understood that the LED element itself may have short rise and fall times, on the order of a few nanoseconds. An even smaller response time for the photosensor may be possible. Such short rise and fall times may correspond to usable maximum driving current frequencies on the order of 100-200 MHz. The white light output of the LED may have rise and fall times longer than rise and fall times of the LED element itself due to time delays associated with the down-conversion process. In one embodiment a blue filter may be used with the photosensor to improve data bandwidth available with the disclosed technology, by filtering out light produced by down-conversion of blue light. Thus, the LED may be capable of transmitting, and the photosensor may be capable of detecting, modulated signals in a frequency range on the order of 100 MHz.

Figure 3:
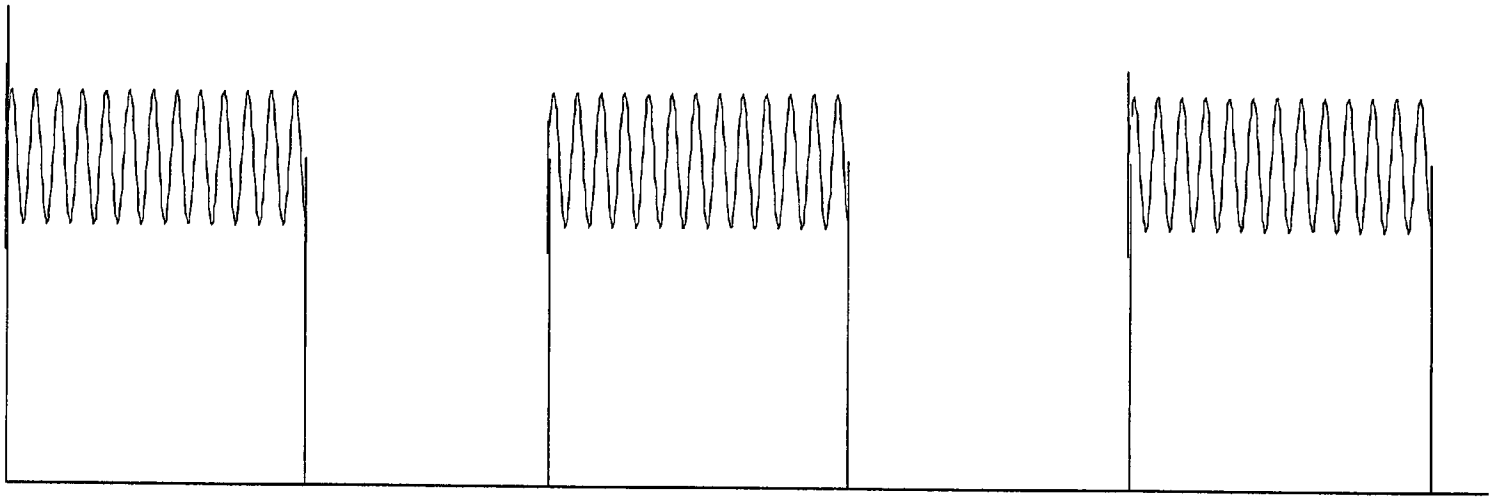
FIG. 3 shows a higher frequency signal impressed for use in conveying data information on a much lower frequency supply signal duty cycle for supplying power to the backlight.

FIG. 3 shows a higher frequency signal impressed on a much lower frequency supply signal duty cycle. Several higher frequency signals of different predefined frequencies may be impressed, providing for multiple data signals impressed on the duty cycle of a single illumination device. The multiple data signals may be digital data encoded using, for example, frequency shift key (FSK) encoding. Other approaches to encoding digital data are within the scope of the present disclosure. For example, because the LED element can support frequencies into the tens or hundreds of megahertz, a signal of frequency on the order of 100 MHz may serve as a carrier frequency, on which digital data can be further impressed before the resultant modulated signal is impressed on the duty cycle of the illumination device. Multiple digital signals may accordingly be impressed on the duty cycle of a single illumination device. As shown in FIG. 3, because the frequency includes both positive and negative current swings, the signal may present during the part of the duty cycle when current is passed to the illumination device, and absent when current is not passed to the illumination device. Alternatively, the data-signal-modulated carrier, FSK encoded signal, or other impressed data signal may be present throughout the duty cycle.

Figure 4:
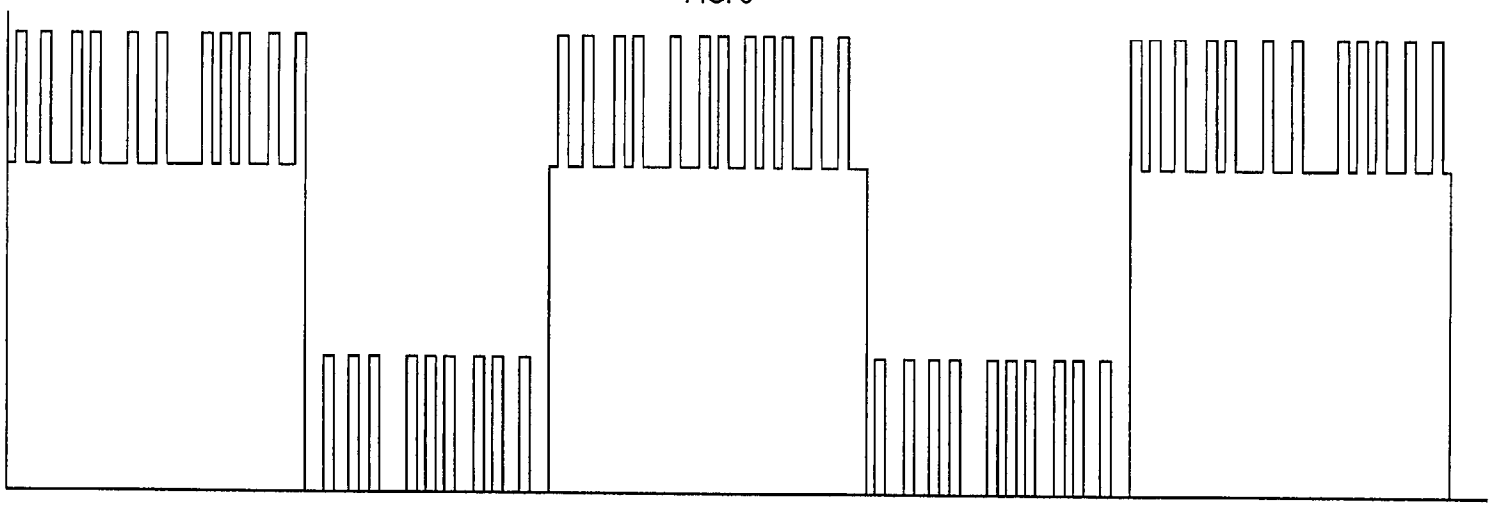
FIG. 4 shows digital data impressed directly on the duty cycle of the supply signal.

FIG. 4 shows digital data impressed directly on the duty cycle of the supply signal. When digital data is impressed directly on the duty cycle, the signal may be present throughout the duty cycle, or may be present during only part of the duty cycle. While the drawings of FIGS. 3 and 4 may not be to scale, in both of FIGS. 3 and 4, the frequency of the impressed data signal may be substantially higher than the frequency of the PWM signal. The substantially higher frequency signals may have predefined frequencies.

Disclosed herein are different embodiments for carrying out the disclosed technology. It is understood the different manners in which to configure the optical data transfer between the first display and the second display are within the scope of this discussion.

Returning to FIG. 2, a two-way light guide is shown between the two displays. In this embodiment, the first display 202 can be larger than the second display 204. The boundaries of the first display are shown as a distance 228. The backlight 206, on the other hand, may extend beyond the boundaries of the first display in at least one direction to support placement of the optical sensor 224 positioned on or near the second display 204. In this way, light from the two way light guide may reach the second display in an area, which may avoid illumination of the first display. Alternatively, where the second display 204 is smaller then the first display, the optical sensor can be placed to coincide with a backlight sized to support the larger first display without interfering with the positioning of the second display.

In some instances, one-way light guides may be used for the first display and the second display. It is understood that the present disclosure could also be applied to a configuration with one-way light guides as well. Were two one-way light guides used, one to illuminate the first display and one to illuminate the second display, a light pipe may be employed to conduct the light from the light guide of the first display to the photosensor 224 of the second display. Alternatively, the photosensor 224 could derive a data signal from a corresponding signal superimposed upon the supply signal of the backlight for the second display.

As mentioned above, in another embodiment, a second backlight circuit having an LED or other illumination device may be positioned, for example, at the other end of the light guide 230 (a similar or duplicate circuit is not shown). Where a plurality of light sources are used, the plurality of light sources can be spatially distinct light sources (at opposite ends of the light guide, for example), which may each support a different superimposed data signal to be received by its own optical sensor to support multiple data signals. That is, in at least one embodiment the backlight device can include an additional illumination device coupled to the other end of the light guide 208 or in a different appropriate location. An additional optical sensor at end 230 can be adapted to receive via the light guide a data signal from the additional illumination device. The display driver 226 or another display driver can be adapted to drive the second display or another display according to additional digital data received by an additional optical sensor. In this manner, a plurality of spatially distinct backlight optical communication circuits can be provided.

Figure 5:
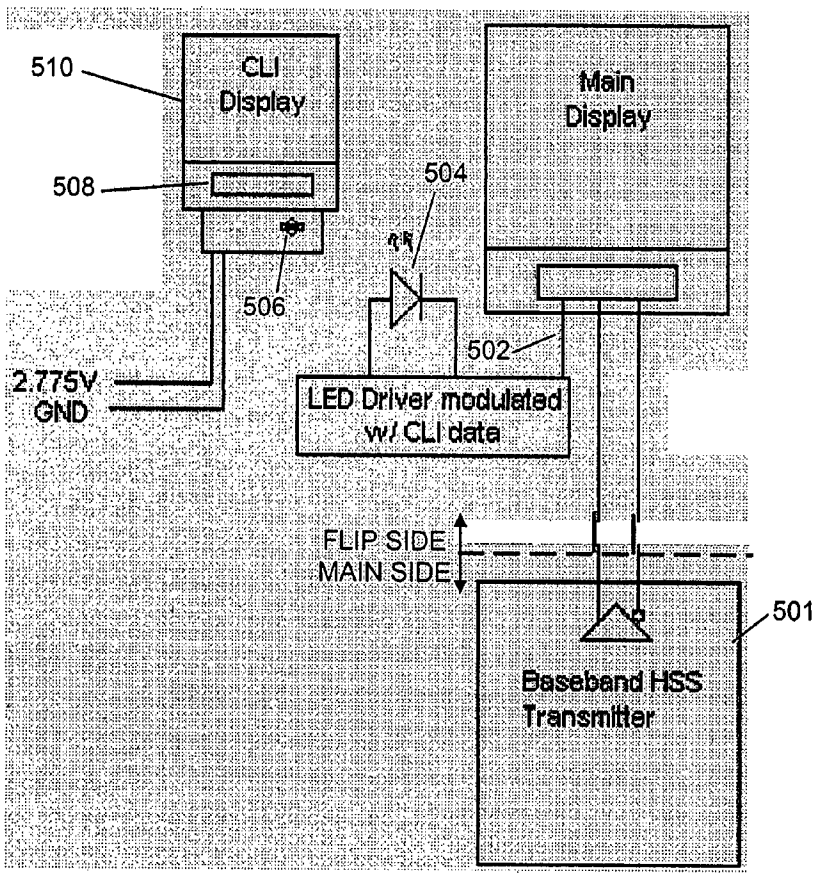
FIG. 5 shows how a baseband high speed serial transmitter may provide data signals for both the main display and second display.

FIG. 5 shows that a baseband high speed serial transmitter 501 in the first housing may-provide data signals for both the first display and second display, in the second housing. The supply signal for a backlight illumination device includes an impressed data signal, as previously discussed, and here is shown as 502. LED 504 provides illumination for a two-way backlight whose light is detected by a photosensor 506. The output from the photosensor is passed to driver 508 which drives the second display 510.

Figure 6:
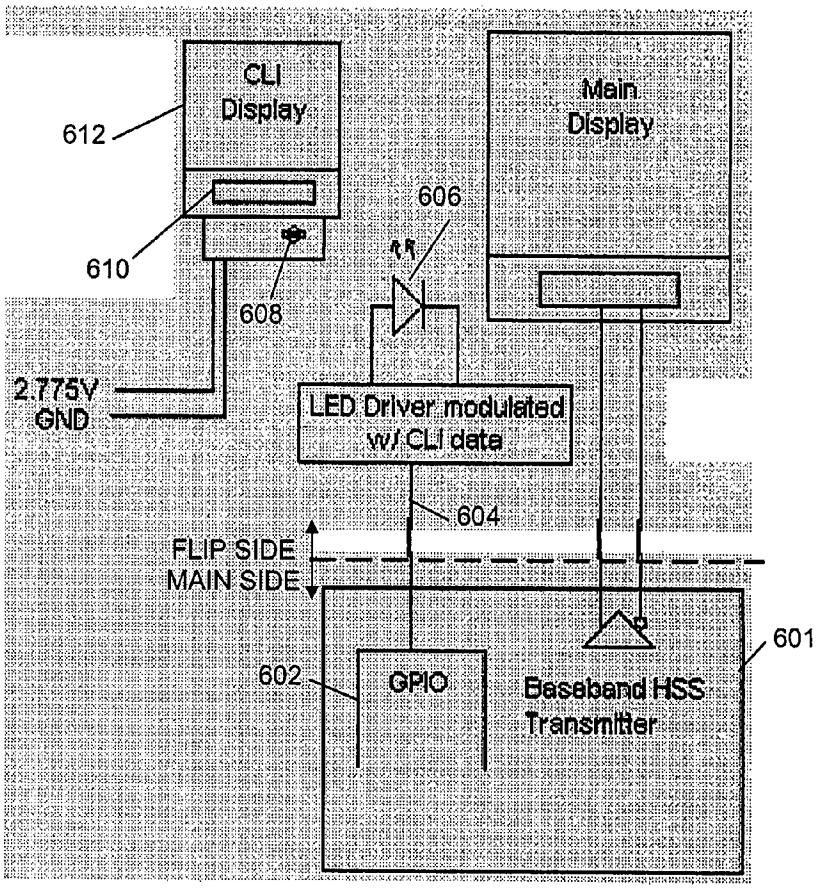
FIG. 6 shows an embodiment in which a baseband high speed serial transmitter may provide data signals for the main display and incorporating a GPIO module and corresponding data line for providing a modulated supply signal to a backlight illumination device for supporting the communication of data signals for a second display.

FIG. 6 shows another embodiment in which a baseband high speed serial transmitter 601 in the first housing may provide data signals for the first display. A general peripheral input-output (GPIO) module 602 may support a data line from the first housing to the second housing providing the supply signal for a backlight illumination device. As previously discussed, the supply signal includes an impressed data signal, and here is shown as 604. LED 606 provides illumination for a two-way backlight whose light is detected by a photosensor 608. The output from the photosensor is passed to driver 610 which drives the second display 612.

Figure 7:
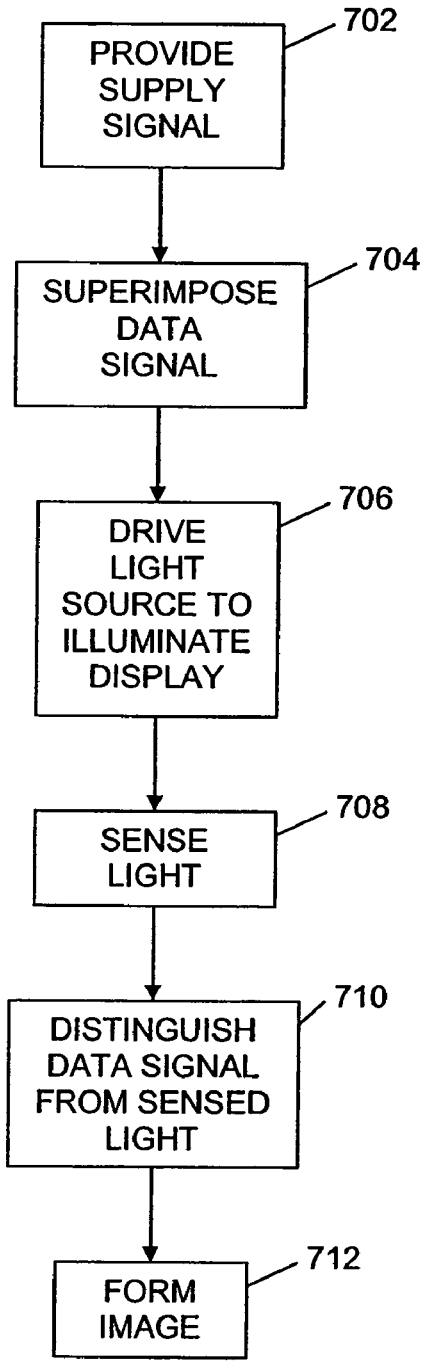
FIG. 7 shows a flow chart illustrating a method for intradevice optical communication as described herein.

FIG. 7 shows a flow chart illustrating a method for intradevice optical communication as described herein. By providing a supply signal 702 and superimposing a data signal 704 to form an optical data link between a first display and a second display, a light source can be driven to produce light to illuminate the second display 706. The intradevice optical communication of data is sensed 708 by a receiver circuit of the second display. The receiver circuit distinguishes data from the sensed light 710. With the data the driver of the second display may form an image on the second display 712. In re-using light from a first display to generate data for the second display, components including wires from the first housing to the second housing can be reduced.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) was chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally and equitable entitled.

The invention claimed is:

1. A device comprising:

a display including a backlight for a display, the backlight comprising one or more light sources;

a driver adapted for receiving a data signal and producing a supply signal for the backlight of the display which includes a superimposed data signal, the supply signal being coupled to the one or more light sources to produce light;

a receiver circuit including an optical sensor which is adapted for sensing the light produced by at least one of the one or more light sources; and wherein the receiver circuit is adapted for distinguishing the data signal from the sensed light.

2. A device in accordance with claim 1, further comprising:

a two part housing including a first housing part and a second housing part that move relative to one another;

wherein a display for output of the data signal is located in either the first housing part or the second housing part; and wherein the particular one of the first housing part and the second housing part within which the display is not located is adapted to house a source for the data signal.

3. A device in accordance with claim 1, wherein:

the display comprises a display component having boundaries;

wherein the backlight is configured to extend beyond the boundaries of the display component in at least one direction to support placement of the optical sensor.

4. A device in accordance with claim 1, wherein the superimposed data signal comprises a plurality of data signals modulated at predefined frequencies.

5. A device in accordance with claim 1, wherein the supply signal has a duty cycle greater than 50% when the backlight is active.

6. A device in accordance with claim 1, wherein the supply signal has a duty cycle less than 50% when the backlight is inactive.

7. A device in accordance with claim 1, wherein the one or more light sources comprise spatially distinct light sources to support multiple data signals.

8. A device in accordance with claim 1, wherein the optical sensor comprises a filter adapted to pass light having higher frequencies.

9. A device in accordance with claim 1, wherein the backlight further comprises a light guide.

10. A device in accordance with claim 1, wherein the data signal comprises digital data used in forming an image on the display.

11. A device in accordance with claim 1, further comprising a secondary display component, wherein the data signal distinguished from the sensed light by the receiver circuit is used in forming an image on the secondary display component.

12. A mobile communication device, comprising:

a display;

a backlight coupled to the display comprising:

a light guide; and an illumination device having a duty cycle and coupled to the light guide;

a display driver configured to drive the display; and an optical sensor coupled to the display driver;

wherein:

the optical sensor is adapted to receive via the light guide digital data impressed on the duty cycle of the illumination device to provide intradevice communication; and the display driver is adapted to drive the display according to the digital data received by the optical sensor.

13. A mobile communication device in accordance with claim 12, further comprising:

a two part housing including a first housing part and a second housing part that move relative to one another;

wherein the display is located in the first housing part; and wherein the second housing part comprises a source for the digital data.

14. A mobile communication device in accordance with claim 12, further comprising an additional optical sensor coupled to the display driver, wherein:

the backlight comprises an additional illumination device having a duty cycle and coupled to the light guide;

the additional optical sensor is adapted to receive via the light guide additional digital data impressed on the duty cycle of the additional illumination device; and the display driver is further adapted to drive the display according to the additional digital data received by the additional optical sensor.

15. A method for intradevice communication in a mobile communication device having a display, the method comprising:

providing a supply signal for a backlight of a display, the backlight including at least one light source;

superimposing a data signal onto the supply signal;

driving the light source of the backlight of the display with the supply signal and the superimposed data signal to produce light to illuminate the display;

sensing the light illuminating the display with an optical sensor coupled to a receiver circuit; and distinguishing the data signal from the sensed light with the receiver circuit.

16. A method in accordance with claim 15, further comprising:

forming an image on the display using the data signal distinguished with the receiver circuit.

17. A method in accordance with claim 15, wherein the supply signal has a duty cycle greater than 50% when the backlight is active.

18. A method in accordance with claim 15, wherein the supply signal has a duty cycle less than 50% when the backlight is inactive.

19. A method in accordance with claim 15, wherein sensing the light comprises filtering the light to pass light having higher frequencies.

20. A method in accordance with claim 15, farther comprising modulating a plurality of data signals at predefined frequencies to form the data signal for superimposing.

* * * * *